US005467538A

United States Patent [19]

Chou et al.

[11] Patent Number: 5,467,538

[45] Date of Patent: Nov. 21, 1995

[54] METHOD AND APPARATUS OF DETERMINING GOLFER'S EFFECTIVE PUTTER LOFT

[75] Inventors: Arthur C. P. Chou, Oceanside, Calif.; Steven Aoyama, Marion, Mass.

[73] Assignee: Acushnet Company, Fairhaven, Mass.

[21] Appl. No.: 316,600

[22] Filed: Sep. 30, 1994

[51] Int. Cl.[6] ..... A63B 69/36; A63B 57/00

[52] U.S. Cl. ..... 33/508; 33/1 N; 33/ 534; 273/186.4; 273/194 A; 273/32 R; 273/32 H

[58] Field of Search ..... 33/508, 1 N, 534; 273/186.4, 187.4, 194 A, 32 R, 32 H

[56] References Cited

U.S. PATENT DOCUMENTS 2,660,436 11/1953 Grossman ..... 33/508

4,858,332 8/1989 Thomas ..... 33/508

4,977,680 12/1990 Marshall ..... 33/508

5,120,358 6/1992 Pippett ..... 273/186.4

5,142,309 8/1992 Lee ..... 273/186.4

*Primary Examiner*—Christopher W. Fulton

*Attorney, Agent, or Firm*—Pennie & Edmonds

[57] ABSTRACT

An apparatus for practicing a method of determining the effective putter loft of a golf putter as swung by a particular golfer in which the putter has a curved face unit placed on the hitting surface and the putter is then swung by such particular golfer against a hitting cylinder. The location of impact between the curved face and hitting cylinder provides data from which the effective loft can be determined.

3 Claims, 4 Drawing Sheets

FIG. 3
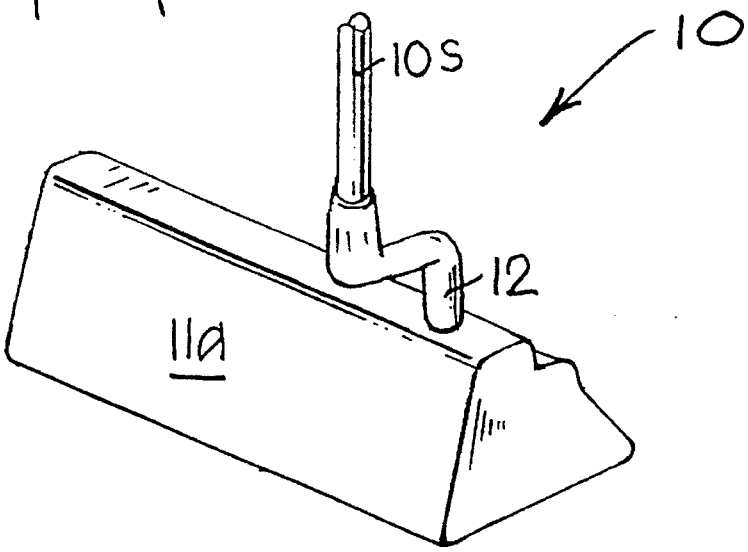
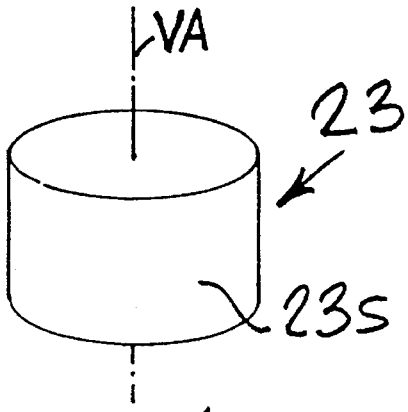
FIG. 4a
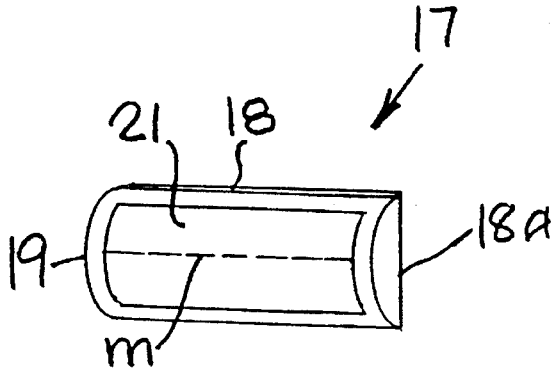
FIG. 4b
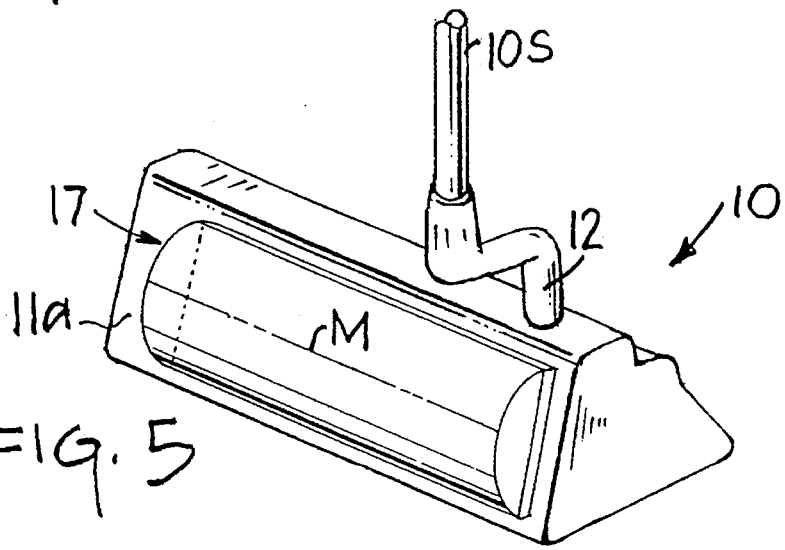
FIG. 5

FIG. 8
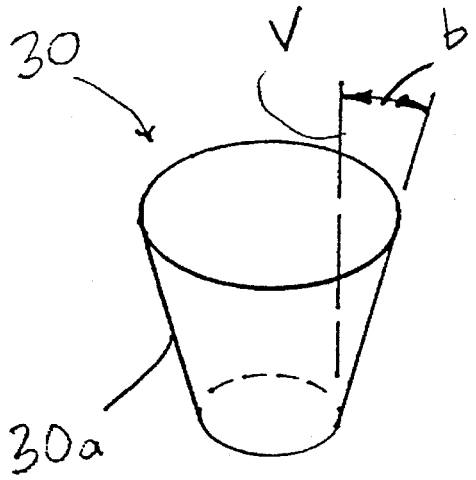
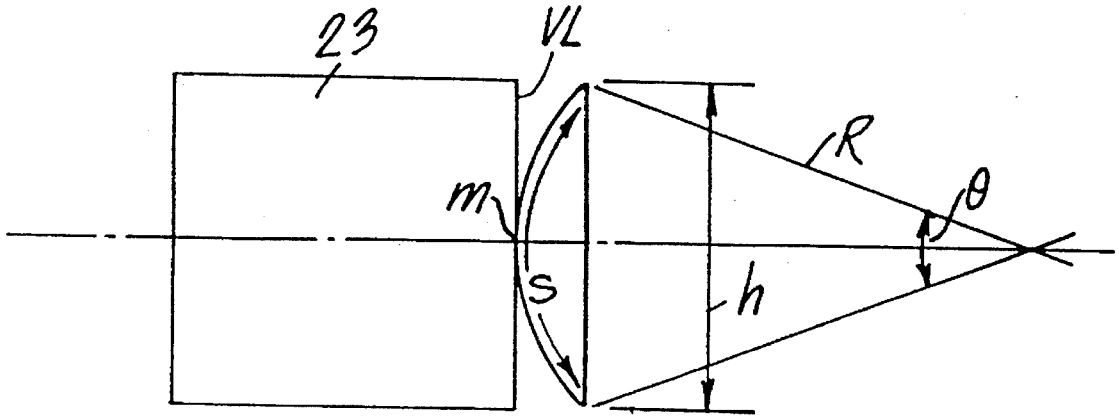
FIG. 8a

METHOD AND APPARATUS OF DETERMINING GOLFER'S EFFECTIVE PUTTER LOFT

BACKGROUND OF THE INVENTION

While it has been known for some time that golfers have differing effective putter lofts, no apparatus or method for readily measuring such loft has been disclosed.

SUMMARY OF THE INVENTION

Broadly, the present invention is a method and apparatus for determining the angle of impact between the putter face and the golf ball for a particular golfer. Putters, as manufactured, have selected lofts which lofts may be effectively modified as a particular golfer addresses and swings the putter. The present invention comprises employing a convex curved face plate that is attached to or forms a part of the putter face; placing marking means such as impact tape on the face plate, causing the golfer to swing the putter to impact a stationary hitting puck, recording the location of impact between the face plate and the hitting puck and thereafter calculating the effective putter loft.

BRIEF DESCRIPTION OF THE DRAWINGS

FIG. 3 is a perspective view of the putter head;

FIG. 4(*a*) is a perspective view of the cylindrical hitting puck;

FIG. 4(*b*) is a perspective view of the putter face plate with an impact tape thereon;

FIG. 5 is a perspective view of the face plate attached to the putter face;

FIG. 8 is a perspective view of an alternative conical hitting puck; and

FIG. 8*a* is an elevational pictorial presentation showing the relationship of the hitting puck and face plate at zero effective loft.

DESCRIPTION OF THE PREFERRED EMBODIMENT

Figure 1:
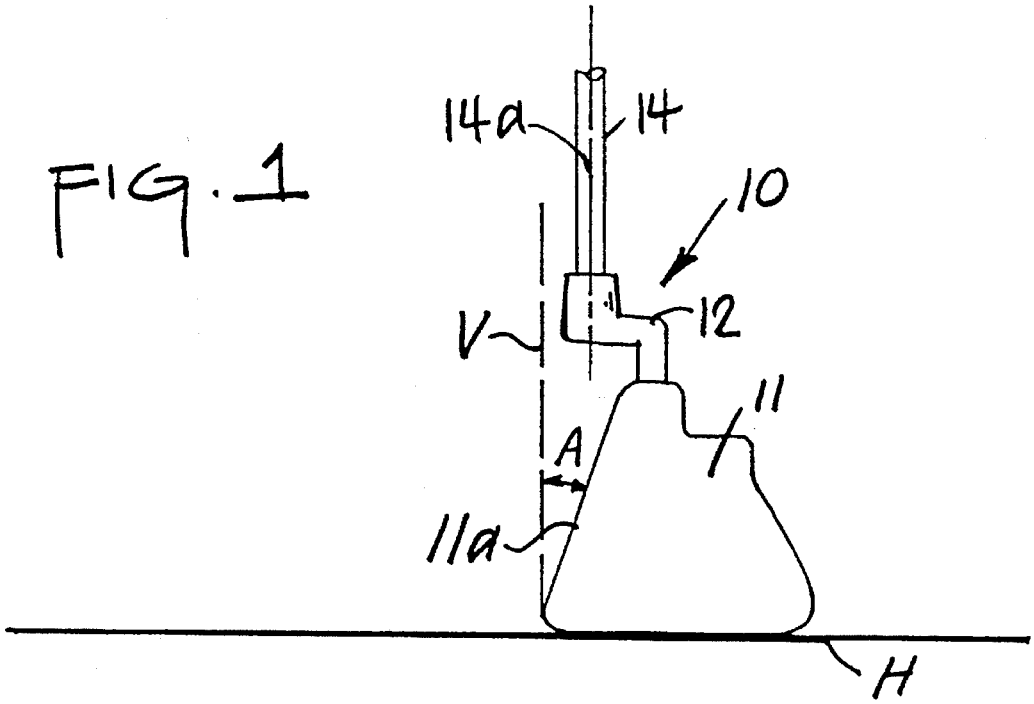
FIG. 1 is a partial end elevational view of a putter with a head and shaft.
Figure 2:
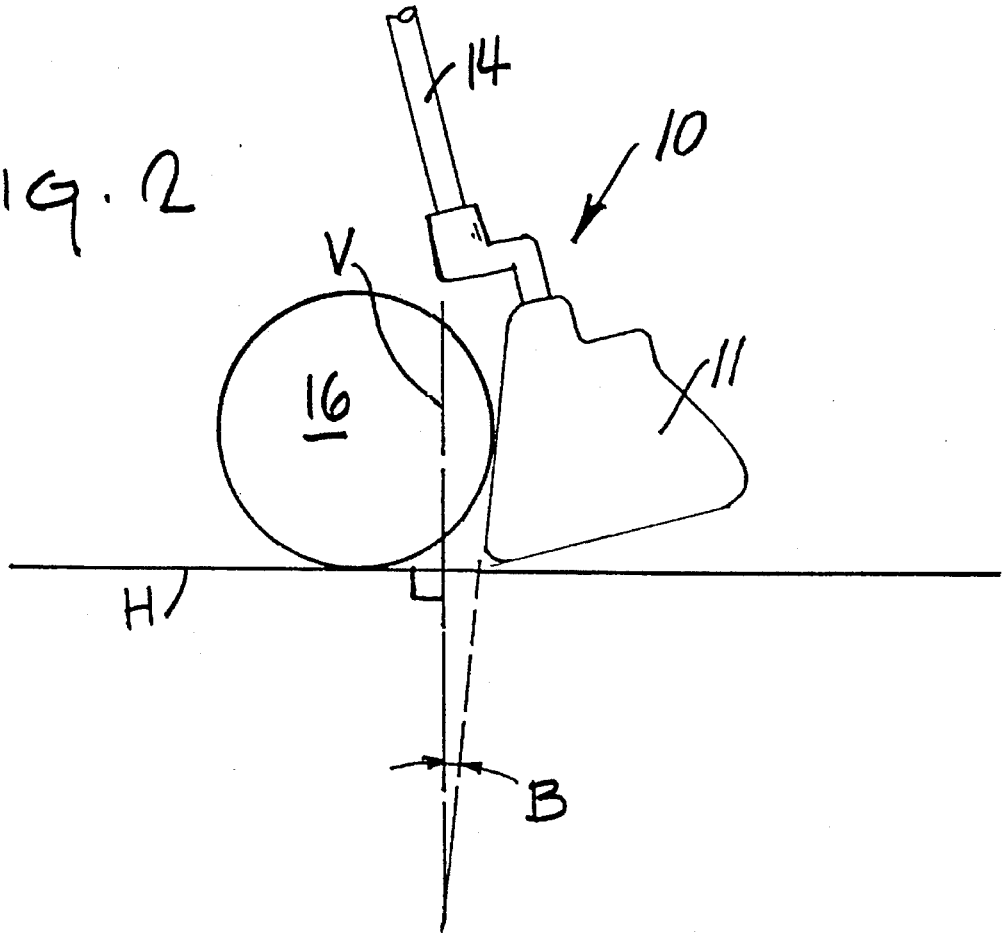
FIG. 2 is an end elevational view of the putter head being swung into impact with a golf ball.

In the figures, putter 10 includes putter head 11, hosel 12, shaft 14 and putter face 11*a*. Putter 10 has a manufactured loft of A measured when shaft axis 14*a* is in a plane perpendicular to the horizontal (H). A is typically in the range of 2 to 7 degrees. When putter 10 is swung with shaft 14 tilted as shown in FIG. 2, the effective loft of putter 10 is reduced to angle B upon impact with ball 16.

Since each golfer's swing varies due to stance, posture and swing pattern, it is useful to be able to measure a particular golfer's effective putter loft. This can be accomplished by creating a test putter or temporarily attaching to a usable putter a face plate unit 17. Unit 17 consists of a body portion 18 with back surface 18*a* which is attachable to putter face 11*a* by use of an adhesive or otherwise. Plate unit 17 also includes a curved face 19 defined by a radius R swung through a vertical plane (FIG. 8). Face 19 has attached to it an impact tape 21 having a horizontal median M thus creating a test striking face (see FIG. 4(*b*) and FIG. 5). Other impact locating means may be used including, for example, electronic sensing devices.

Figure 6:
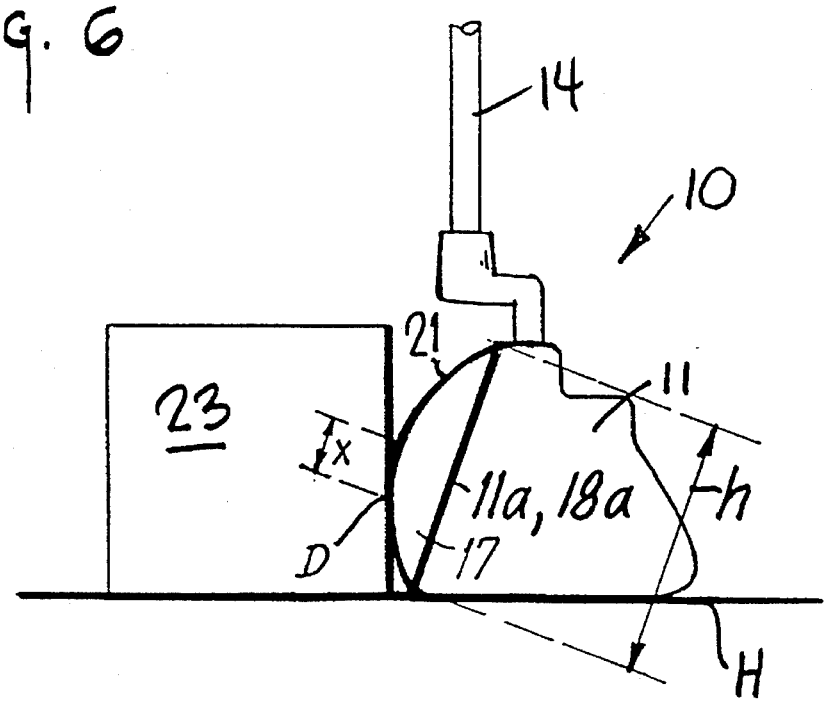
FIG. 6 is an end elevational view of the putter with the face plate attached and being swung against the hitting puck.

Turning now to FIG. 6, putter 10 with face plate unit 17 attached is swung by a golfer using his or her normal swing into contact with stationary cylindrical hitting puck 23 (see FIG. 4(*a*)). Preferably, puck 23 is approximately the size of a golf ball. Puck 23 is preferably a right circular cylinder, but may be any right cylinder or right cone. Puck continuous cylindrical side 23*s* is equidistant from vertical axis VA. Side 23*s* is composed of an infinite number of vertical lines (VL). The golfer's swing illustrated in FIG. 6 is such that tape 21 impacts puck side 23*s* at point D below median horizontal line M defining the middle of face 19. To determine the effective putter loft from this data, it is first necessary to calculate the sensitivity of the face plate.

FIG. 8 shows an alternative hitting puck 30 which is conical in shape. Puck 30 has a hitting surface 30*a* which is at an angle b from the vertical (V). This angle b is compensated for in making the calculations required as herein disclosed.

Turning to FIG. 8*a*, the sensitivity can be defined as Θ/S, or the angular displacement per unit arc length measured vertically along the curved putter face or face plate.

$$S = \frac{\theta}{57.3} R$$

$$\boxed{\text{Sensitivity} = \frac{\theta}{S} = \frac{57.3}{R}}$$

Returning to the example of FIG. 6, if R is given as 5.73 inches then the sensitivity is 10 degrees per inch, meaning that every inch of vertical travel along the curved face represents 10 degrees of loft change.

The effective loft is now given by $$\boxed{\text{Effective Loft} = X\frac{\theta}{S} + b}$$

where X is the arc length measured between M and D (positive if D is below M) and b is the wall angle of a conical puck as shown in FIG. 8 (positive if the puck is wider at the top). If X is measured as 0.3 inches and the puck is cylindrical, then $$\begin{aligned} \text{Effective Loft} &= .3 \text{ in } (10 \text{ deg/in}) + 0 \text{ deg} \\ &= 3 \text{ deg} \end{aligned}$$

Figure 7:
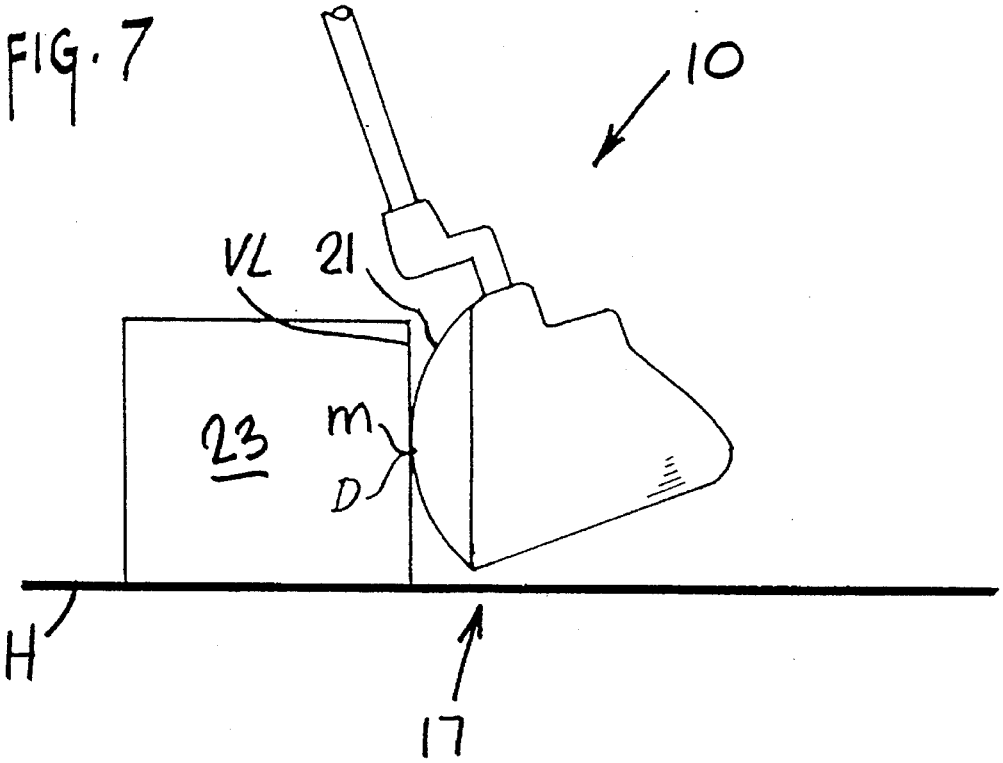
FIG. 7 is a view similar to FIG. 6 with the putter being swung to create a zero effective loft.

FIG. 7 depicts a special case in which the player strikes the cylindrical puck with his hands well forward, such that D and M coincide. In this case, X is zero so the effective loft is also zero.

It is also possible to calculate the total range of measurement available with a given face or face plate. Returning again to FIG. 8, the total range Θ can be derived as follows:

$$R \sin\left(\frac{\theta}{2}\right) = \frac{h}{2}$$

$$\frac{\theta}{2} = \sin^{-1}\left(\frac{h}{2R}\right)$$

$$\boxed{\text{Range} = \theta = 2\sin^{-1}\left(\frac{h}{2R}\right)}$$

For the example of FIG. 6, if h is 1 inch, then $$\boxed{\text{Range} = 2\sin^{-1}\left(\frac{1\text{ in}}{2(5.73\text{ in})}\right)}$$

$$= 10.0\text{ deg}$$

Through judicious choice of h and R, a putter face or face plate can be designed having both sufficient range and adequate sensitivity.

I claim:

1. An apparatus for measuring the effective loft of a golf putter when swung by a golfer comprising:

a) a putter having i) a shaft;

ii) a curved test striking face in place of the ball striking face; and iii) a means of locating the impact point on the curved test striking face; and b) a cylindrical or conical hitting puck having a curved face, which puck is positioned on a horizontal surface with its axis in a vertical position.

2. A method of measuring the effective loft of a golf putter when swung by a golfer comprising the steps of a) providing on the putter a curved puck striking face;

b) positioning a cylindrical or conical hitting puck on a horizontal surface with its axis vertical;

c) swinging the golf putter to cause the curved face to engage the puck;

d) measuring the point on the curved face where it struck the puck; and e) thereafter computing the effective loft.

3. The method of claim 2 having in addition the steps of attaching impact tape to the curved face unit.

* * * * *